United States Patent [19]

Buck

[11] Patent Number: 4,680,500

[45] Date of Patent: Jul. 14, 1987

[54] INTEGRAL GRID/CATHODE FOR VACUUM TUBES

[75] Inventor: Erik S. Buck, Dayton, Ohio

[73] Assignee: The United States of America as represented by the Secretary of the Air Force, Washington, D.C.

[21] Appl. No.: 836,876

[22] Filed: Mar. 6, 1986

[51] Int. Cl.[4] ..... H01J 1/46; H01J 1/52; H01J 17/04; H01J 17/12; H01J 19/38

[52] U.S. Cl. ..... 313/348; 313/346 R; 313/338; 313/304; 313/293; 313/444; 313/447; 445/47; 445/50

[58] Field of Search ..... 313/348, 302, 303, 304, 313/338, 346, 346 DC, 268, 293, 296, 444, 446–448; 445/47, 50

[56] References Cited

U.S. PATENT DOCUMENTS

| | | | |
|---|---|---|---|
| 2,782,334 | 2/1957 | Gardner | 313/338 R |
| 2,953,706 | 9/1960 | Gallet et al. | 313/304 X |
| 3,651,360 | 3/1972 | Sommeria | 313/82 R |
| 3,967,150 | 6/1976 | Lien et al. | 313/304 |
| 4,101,800 | 7/1978 | Thomas et al. | 313/346 DC |
| 4,227,116 | 10/1980 | Miram et al. | 313/447 |
| 4,254,357 | 3/1981 | Haas et al. | 313/268 |
| 4,263,528 | 4/1981 | Miram | 313/344 |
| 4,310,603 | 1/1982 | Falce | 313/346 R |
| 4,371,809 | 2/1983 | Thomas et al. | 313/346 DC |
| 4,379,979 | 4/1983 | Thomas et al. | 313/346 R |
| 4,405,878 | 9/1983 | Oliver | 313/346 R |
| 4,572,982 | 2/1986 | Farrall | 313/348 |
| 4,587,455 | 5/1986 | Falce et al. | 313/346 R |

*Primary Examiner*—Saxfield Chatmon

*Attorney, Agent, or Firm*—Bernard E. Franz; Donald J. Singer

[57] ABSTRACT

The structure is material such as a ceramic in the form of a bundle of open cells, a "honeycomb", with the shape of the cells corresponding to the shape of the openings desired in the grid. The cathode is formed in the cells, rather than adding the grid to a ready-made cathode. The grid is formed by coating the end of the cell walls with a conducting material (metal and/or carbon). The surface of the cathode is suitably recessed from the grid.

9 Claims, 6 Drawing Figures

INTEGRAL GRID/CATHODE FOR VACUUM TUBES

RIGHTS OF THE GOVERNMENT

The invention described herein may be manufactured and used by or for the Government of the United States for all governmental purposes without the payment of any royalty.

BACKGROUND OF THE INVENTION

This invention relates to an inegrated assembly for the grid and cathode of a vacuum tube, and more particularly of a travelling wave tube (TWT).

Vacuum tube amplifiers typically use control grids to control the emission from a cathode. In a typical linear beam tube, for example, as used in military microwave systems (radar, electronic countermeasures, etc.), the cathode is a porous tungsten cylinder or plug. The plug is mounted in a support structure, such as a molybdenum sleeve, with a heater. The cathode plug is machined with a spherical concave end and is impregnated with various compounds which reduce the work function. Then the grids are added. The grids (typically molybdenum) are formed to be concentric with the cathode. They are delicate structures, a net-like configuration with dimensions (thickness) on the order of mils. They are formed by electric discharge machining (EDM) or etching and typically cost on the order of $100 each. The control grid lies close (perhaps 1–3 mils) to the cathode, where it is radiatively heated to about 1000 degrees C. and also subjected to electron bombardment. To reduce the latter, the interception current, a shadow grid is commonly used. The shadow grid is placed on or close to the cathode surface to suppress emission directly next to the control grid. The two grids must be exactly in line and precisely spaced and, or course, electrically isolated. The assembly of the grids is an expensive operation, and typically the yield of acceptable electron guns is low (50%). The assembly is fragile. Often the grids warp out of shape, which effectively ruins a tube which can cost several thousand dollars (some cost $100,000). Attempts to mechanically stabilize the grid locations have included using diamond standoffs between the grids. This failed, because the diamonds deteriorated and became electrically conductive.

United States patents of interest are U.S. Pat. No. 3,651,360 to Sommeria, No. 4,227,116 to Miram et al, No. 4,254,357 to Haas et al and No. 4,405,878 to Oliver. Haas et al are concerned with a multi-arrayed micropatch electron emitter or cathode having an integral control grid. In FIG. 2 of the patent a control grid 20 is shown spaced from a cathode 12 by an isolator 24 and a high temperature insulator 22. The honeycomb nature of the patented construction is illustrated in FIG. 1. Oliver in FIG. 13 also shows a grid separated from a cathode by layers of material including an insulation layer BN. Sommeria illustrates in FIG. 2 a honeycomb screen grid 10 located on a cathode 1 with a thin support spacing the screen grid from the cathode and thermally isolating the two. Miram et al show in FIG. 2 a concave cathode 20 formed with spaced concave electron emitting depressions 24 and non-emissive grid elements 26 covering the spaces between them. Conductive web elements 28 of a control grid 22 are aligned with the non-emissive shadow grid elements 26 so that small beamlets of electrons are focused through the apertures 29 of grid 22 and miss the conductive web elements 28. However, none of the references suggest a honeycomb ceramic structure for supporting both individual cathodes and a grid. Also of interest is a copending patent application Ser. No. 756,888 filed July 19, 1985 by Amer et al for an "Intergrated Grid Structure", in which the grid assembly comprises two fine photoetched grids of similar geometry brazed into a sandwich structure in which they remain spaced and electrically isolated from each other by small dielectric posts (spacers) of very small thickness.

Current practice involves a complex and fragile assembly of several parts to form an "integrated grid structure". This is costly, with many process steps, precious metals, etc. The need for grids leads to the problem of how a control grid can be made which is not expensive, which is protected from electron bombardment, which is closely and concentrically spaced from the cathode surface, which is mechanically strong, and which is electrically insulated from the cathode.

SUMMARY OF THE INVENTION

An object of the invention is solve the above problem, and to provide an integral grid/cathode which is less expensive to make and more reliable in service, reducing one of the major failure modes in vacuum tubes, such as travelling wave tubes.

The solution to the problem lies in a novel way of forming the cathode in/on the grid support structure, rather than adding the grid to a ready-made cathode. There are several ways to accomplish this. This invention is directed to a novel integrated assembly for the grid and cathode of a travelling wave tube (TWT) and a methode of making it. It comprises an insulating ceramic structure in the form of a bundle of open cells or "honeycomb", with the shape of the cell corresponding to the shape of the opening desired in the grid. The cathode is formed in the cells, and the grid is formed by coating the end of the cell walls with a conducting material (metal and/or carbon). The surface of the cathode is suitably recessed from the grid to in effect form a separate cathode for each cell of the grid. This continuous support arrangement eliminates the need for a separate shadow grid. Features of the invention include the following:

(1) The grid is formed on the supporting structure, rather than attaching insulating supports to a preformed grid;

(2) The cathode is formed in place in the grid support structure, forming, in effect, a separate cathode for each cell of the grid;

(3) The grid is continuously supported, forming a robust and rigid structure; and (4) The continuous support eliminates the need for a separate shadow grid.

DETAILED DESCRIPTION

Figure 1:
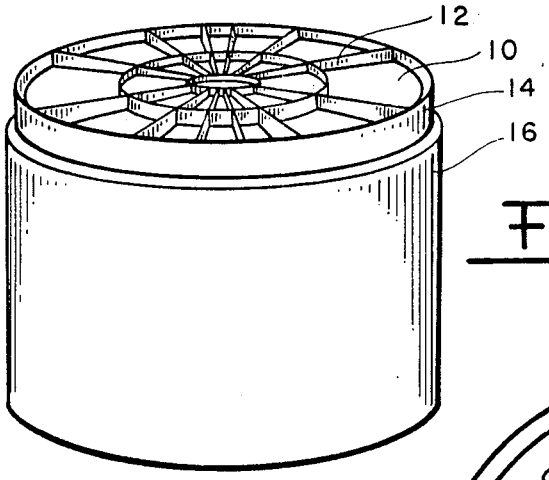
FIG. 1 is a pictorial view of a grid-cathode structure.
Figure 2:
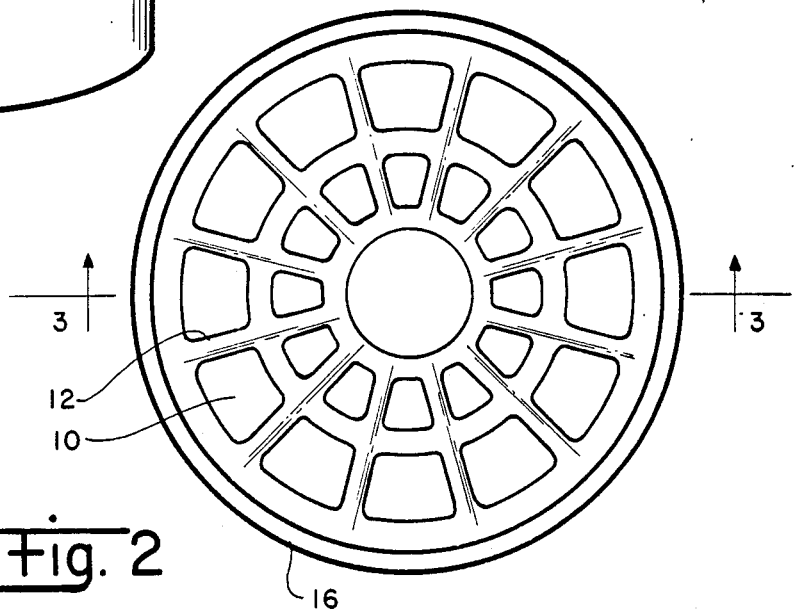
FIG. 2 is a top view of the structure.
Figure 3:
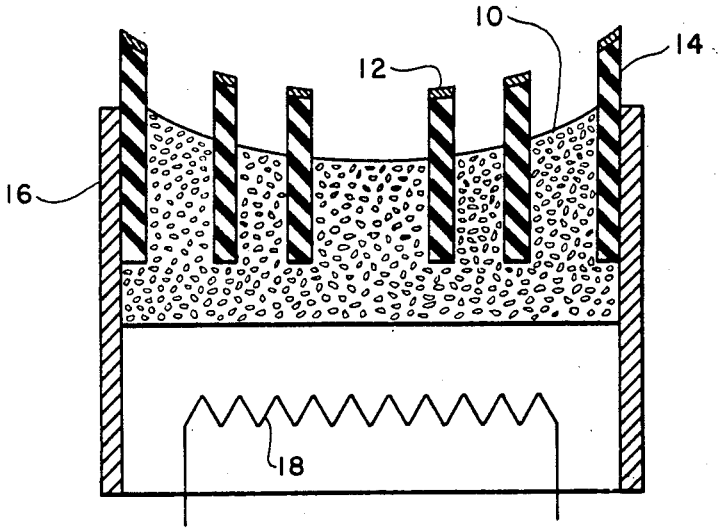
FIG. 3 is a symbolic sectional view of the structure, taken along lines 3—3 of FIG. 2.

Referring to FIGS. 1, 2 and 3, the configuration of cathode 10 and grid 12 in an integrated assembly, comprises the cathode and grid formed in/on an insulating (e.g., ceramic) structure 14. The structure is a bundle of open cells, a "honeycomb", with the shape of the cell corresponding to the shape of the opening desired in the grid. The cathode is formed in the cells, and the grid is formed by coating the end of the cell walls with a conducting material (metal and/or carbon). The surface of the cathode is suitably recessed from the grid.

An insulating structure with a coefficient of thermal expansion close to that of cathode material, likely a ceramic, is formed (e.g., by extrusion) into a multiplicity of open cells, a "honeycomb". The cells are filled with cathode matrix material (preferably a porous arrangement of tungsten-osmium and/or rhenium alloy powder) except that the cathode material is recessed from the ends of the cell by the amount of the desired grid spacing (typically about 0.001 to 0.003). The grid is formed by coating the ends of the cell walls with conducting material. The cathode matrix is impregnated with the customary impregnants, complex barium compounds. The cathode/grid assembly is mounted in the customary way, with a metal sleeve 16 and a potted heater 18. The optimum sequence for these processes needs to be determined.

In designing the grid-cathode structure, attention should be given to the following. (1) It may be difficult to press the cathode matrix into the structure with the required recess or to fill the structure entirely and etch-back to form the recessed surface. Possibly the matrix should be more plastic, less rigid, than the conventional cathode. (2) Thermal cycling, as when sintering the matrix, may cause a separation of the matrix and the supporting structure. Even if this happens it may be insignificant. (3) The impregnant may wet the surface of the grid support, causing a parasitic resistance in parallel with the grid circuit. This should be amenable to being minimized experimentally. (4) The grid support structure may acquire a static charge (the opposite of 3, above) which distorts the electron optics. This seems unlikely to be a problem. (5) The electrical connection to the grid may be fragile, as there is no large surface to weld to. Probably a robust conducting ring can be attached to or pressed against the periphery of the grid to form a satisfactory connection.

Figure 4:
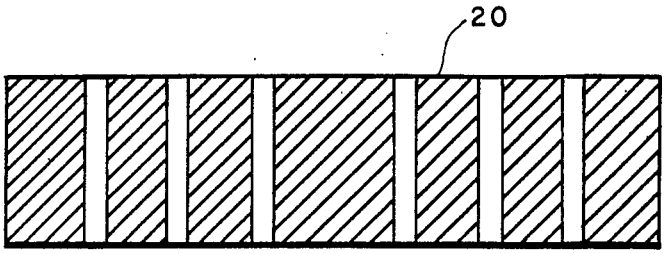
FIG. 4 is a cross-sectional view of a mold for forming a honeycomb support.
Figure 5:
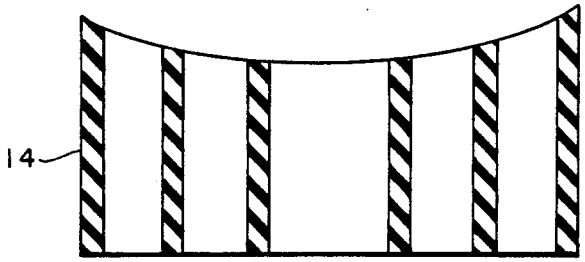
FIG. 5 is a cross-sectional view of the honeycomb structure alone.

One embodiment of forming the cathode on the grid structure is as follows:

1. Form a "honeycomb" structure 14 as shown in FIG. 5 of a strong, insulating material which resists wetting by barium at barium vapor temperatures. A cermicist can provide a suitable material (ceramic or glass) and form it into a structure of parallel open cells. Beta-spodumene suggets itself as a candidate, as it is readily formed into the required structure (as has been done for heat exchangers), has a low coefficient of thermal expansion, etc. The ceramic is made into a "plug" the shape of a cathode (i.e. cylindrical, with a concave end, with the open channels running parallel to the axis). The honeycomb structure might be formed by extruding the material through a form 20 such as shown in FIG. 4, firing, cutting it to the required length and machining to form the spherical surface for the grid.

2. The control grid 12 as shown in FIG. 3 is formed by metallizing the concave end of the ceramic plug. If, for instance, the ceramic "honeycomb" walls are 5 mils thick, then a grid is formed, the vanes of which are about 5 mils wide, in perfect alignment and identical curvature to the ceramic. (Whether this operation is done at this point in the production sequence or later is not crucial.)

Figure 6:
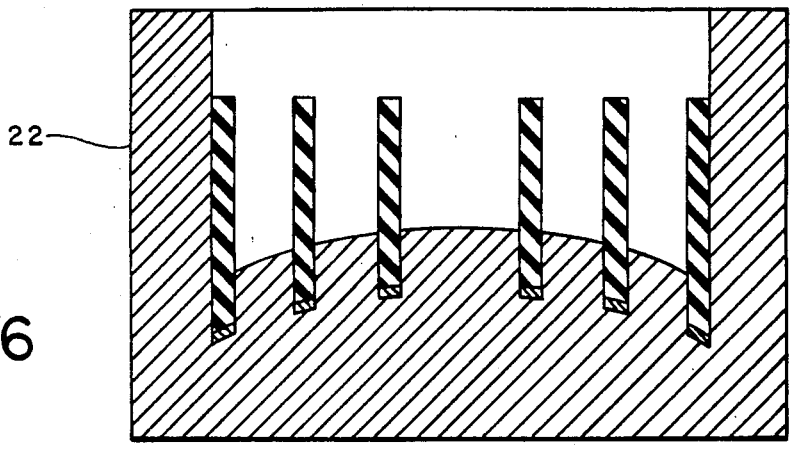
FIG. 6 is a cross-sectional view of a fixture for forming the cathode, with the honeycomb structure and grid in place.

3. As shown in FIG. 6, the plug is placed in a fixture 22 which is a receptacle for the grid end of the honeycomb and which accepts the ceramic to a depth which is appropriate to the desired spacing of the control grid from the cathode (e.g. 0.0010 inch plus the grid thickness). (If such fixturing seems too complex to be economical, the cathode may be formed (step 4, below) flush with the ceramic. The cathode matrix would then be etched away to a depth corresponding to the grid spacing, followed by the metalization of the grid and impregnation of the cathode matrix.)

4. The balance of the open cells of the honeycomb is filled with cathode material 10, as shown in FIG. 3. This could be tungsten powder (or a tungsten-osmium alloy and/or rhenium) which is then sintered and impregnated, or it could be a mixture of tungsten and impregnant, if a mixture can be found which remains solid and dimensionally stable at operating temperature. This operation essentially forms a mutiplicity of cathodes which are aligned with and spaced from the open cells of the grid.

5. The plug is removed from the fixture. The plug is packaged (mounted with a cathode heater) and electrically connected to the cathode and grid supplies.

In operation, the control grid is "shadowed" by the supporting ceramic. The grid is nowhere unsupported, so it cannot change shape. The effective cathode surface is the same as it would be if a single cathode "plug" had been machined and then shadowed with a grid. Assuming a reasonable compatabiliaty in expansion between the ceramic and the cathode matrix material during thermal cycling, the assembly of tungsten and ceramic should be more than adequately strong. The only likely failure mode not found in conventional gridded guns would be the possibility that barium (from the cathode impregnant) would deposit on the exposed ceramic sufficiently to short out the grid. This is not likely, as at the normal operating temperature of the ceramic any coating of barium should evaporate. It can be projected that an electron gun which uses this "integral control grid" will be easier to make and less expensive than a conventional shadow-grided cathode-gun assembly. Further, it should be more robust and reliable. The distortion of the electric field caused by the presence of the ceramic will have a negligible effect on the electron optics of the gun.

It is understood that certain modifications to the invention as described may be made, as might occur to one with skill in the field of the invention, within the scope of the appended claims. Therefore, all embodiments contemplated hereunder which achieve the objects of the present invention have not been shown in complete detail. Other embodiments may be developed without departing from the scope of the appended claims.

What is claimed is:

1. The method of forming an integrated grid-cathode structure comprising the steps of:

forming a plug in the form of a honeycomb structure having parallel open cells, using a strong, insulating material which resists wetting by barium at barium vapor temperatures, with one end being designated the grid end for a control grid;

placing said plug in a fixture which is a receptacle for said grid end of the plug;

filling the open cells in the honeycomb structure of the plug with cathode material which include barium compounds, to thereby form a cathode matrix;

removing the plug from the fixture; and at some time following formation of the plug, forming a control grid by coating said grid end of the plug with conductive material.

2. The method according to claim 1, wherein said plug is made the shape of a cathode which is cylindrical, with said one end concave, and with said cells being open channels running parallel to the axis; and wherein said fixture accepts the plug to a recess depth, the recess being of a depth which is appropriate to a desired spacing of a control grid from the cathode.

3. The method according to claim 2, wherin the material for said plug is selected from the class including ceramic and glass.

4. The method according to claim 3, wherein the material for the plug is Beta-spodumene.

5. The method according to claim 1, wherein said plug is made of a ceramic material into the shape of a cathode which is cylindrical, with said one end concave, and with said cells being open channels running parallel to the axis; and wherein said fixture accepts the plug flush with said one end;

after removal from the fixture, etching away the cathode matrix at said one end to a depth corresponding to the grid spacing, followed by said coating of the grid and impregnation of the cathode matrix.

6. An integrated grid-cathode structure comprising:

a plug in the form of a honeycomb structure having parallel open cells, of a strong, insulating material which resists wetting by barium at barium vapor temperatures;

a control grid comprising a conductive coating on one end of said plug; and a cathode matrix of a material which includes barium compounds, formed in the open cells of the honeycomb structure of the plug, the cathode matrix being recessed to provide a given spacing of the control grid from the cathode.

7. The integrated grid-cathode structure according to claim 6, wherein said plug is made the shape of a cathode which is cylindrical, with said one end concave, and with said cells being open channels running parallel to the axis.

8. The integrated grid-cathode structure according to claim 7, wherein the material for said plug is selected from the class including ceramic and glass.

9. The integrated grid-cathode structure according to claim 8, wherein the material for the plug is Beta-spodumene.

* * * * *